United States Patent [19]

Anderson

[11] Patent Number: 4,739,227

[45] Date of Patent: Apr. 19, 1988

[54] FLUORESCENT LAMP DIMMING OVER LARGE LIGHT OUTPUT RANGE

[75] Inventor: John M. Anderson, Scotia, N.Y.

[73] Assignee: General Electric Company, Schenectady, N.Y.

[21] Appl. No.: 911,854

[22] Filed: Sep. 26, 1986

[51] Int. Cl.[4] ..... H05B 41/29; H05B 37/00; H05B 41/24

[52] U.S. Cl. ..... 315/260; 315/334; 315/336; 315/DIG. 1; 315/DIG. 4; 315/276; 315/264; 315/202; 313/602; 313/581

[58] Field of Search ..... 315/261-266, 315/DIG. 1, DIG. 4, 335, 336, 203, 204, 260, 334, 233, 194; 313/601, 602; 355/69

[56] References Cited

U.S. PATENT DOCUMENTS 2,843,805 7/1958 Brodersen ..... 315/266

3,611,024 10/1971 Nakatsu et al. ..... 315/205

4,383,197 5/1983 Gungle et al. ..... 313/602 X

*Primary Examiner*—David K. Moore

*Assistant Examiner*—Mark Powell

*Attorney, Agent, or Firm*—Geoffrey H. Krauss; James C. Davis, Jr.; Marvin Snyder

[57] ABSTRACT

A fluorescent lamp has an envelope tube forming a gas-tight enclosure about a pair of externally-energizable filaments which generate a plasma discharge for conversion to visible light; a keep-alive electrode is located adjacent to at least one filament. A dimming control circuit individually externally energizes each keep-alive electrode to generate an auxiliary discharge, between that keep-alive electrode and the adjacent filament, at a magnitude sufficient to maintain the adjacent filament in the spot mode of operation even if the main plasma discharge current is varied over a range sufficient to change the visible light output of the lamp over at least a 10:1 range.

20 Claims, 1 Drawing Sheet

FLUORESCENT LAMP DIMMING OVER LARGE LIGHT OUTPUT RANGE

The present invention relates to fluorescent lamps and, more particularly, to a novel lamp and a novel dimming method for operating that fluorescent lamp over a large light output range without reduced lamp life.

Dimming of fluorescent lamps has long been a subject of investigation. The prior art is voluminous, although known apparatus allowing a fluorescent lamp to be dimmed over a large light output range generally causes a concomitant reduction in lamp life, due to electrode deterioration. Because of this, most fluorescent lamp dimming schemes utilize some means to supply auxiliary heat to the electrodes, when the lamp current is reduced to provide less light in the plasma column. Such schemes require that the entire electrode be heated by an auxiliary source. The column current density reduction does not provide enough power concentration at the electrode to keep an emitting spot and thus allows the electrode mode of operation to change to a diffuse-emitting mode. Since the diffuse operating mode must be sustained by auxiliary heating of the electrode, this allows more heat to be radiated and conducted to the lamp tube walls. Auxiliary source heating is a relatively inefficient mode of operation (which is also subject to barium evaporation). Therefore, a conventional fluorescent lamp is generally limited to dimming over about a 10:1 maximum range without undergoing a degree of depreciation substantially reducing lamp life. It is therefore highly desirable to provide a novel fluorescent lamp, and a novel method for operation of that lamp, which provides for a larger light output dimming range (in excess of 10:1) without substantial lamp life depreciation.

BRIEF SUMMARY OF THE INVENTION

In accordance with the invention, my novel fluorescent lamp comprises: an envelope tube, forming a gas-tight enclosure; a plurality of externally-energizable filaments, each spaced from all others within the tube envelope; means contained within the tube envelope and cooperating with the filaments for generating a plasma discharge within the tube; means within the tube for converting energy from the discharge to visible light; and keep-alive electrode means located adjacent to at least one filament and individually externally-energizable for generating an auxiliary discharge between each of the keep-alive electrodes and the adjacent filament, at a magnitude sufficient to maintain the adjacent filament in a spot mode of operation even if the plasma discharge current density is varied over a range sufficient to change the visible light output of the lamp over at least a 10:1 range. The lamp is connected, via controllable switching devices, to a ballast transformer; control means operate the switching devices to separately control average current flow through each of the main discharge and the auxiliary discharge, during each different polarity half-cycle of an AC source waveform.

In a presently preferred embodiment, the lamp has two filaments with an annular auxiliary keep-alive electrode located around each. Each auxiliary electrode receives the same operating potential polarity as that polarity received by the filament furthest from that auxiliary electrode. A separate ballast inductor is provided in series with each keep-alive electrode to facilitate re-ignition of the auxiliary discharge from that electrode during each source waveform cycle.

Accordingly, it is a object of the present invention to provide a novel fluorescent lamp, capable of being dimmed over a large light output range.

It is another object of the present invention to provide a novel method for operation of a fluorescent lamp capable of being dimmed over a large light output range.

It is still another object of the present invention to provide a novel circuit for dimming over a large light output range a fluorescent lamp having keep-alive auxiliary electrodes.

These and other objects of the present invention will become apparent upon reading of the following detailed description, when considered in conjunction with the associated drawings.

DETAILED DESCRIPTION OF THE INVENTION

Figure 1:
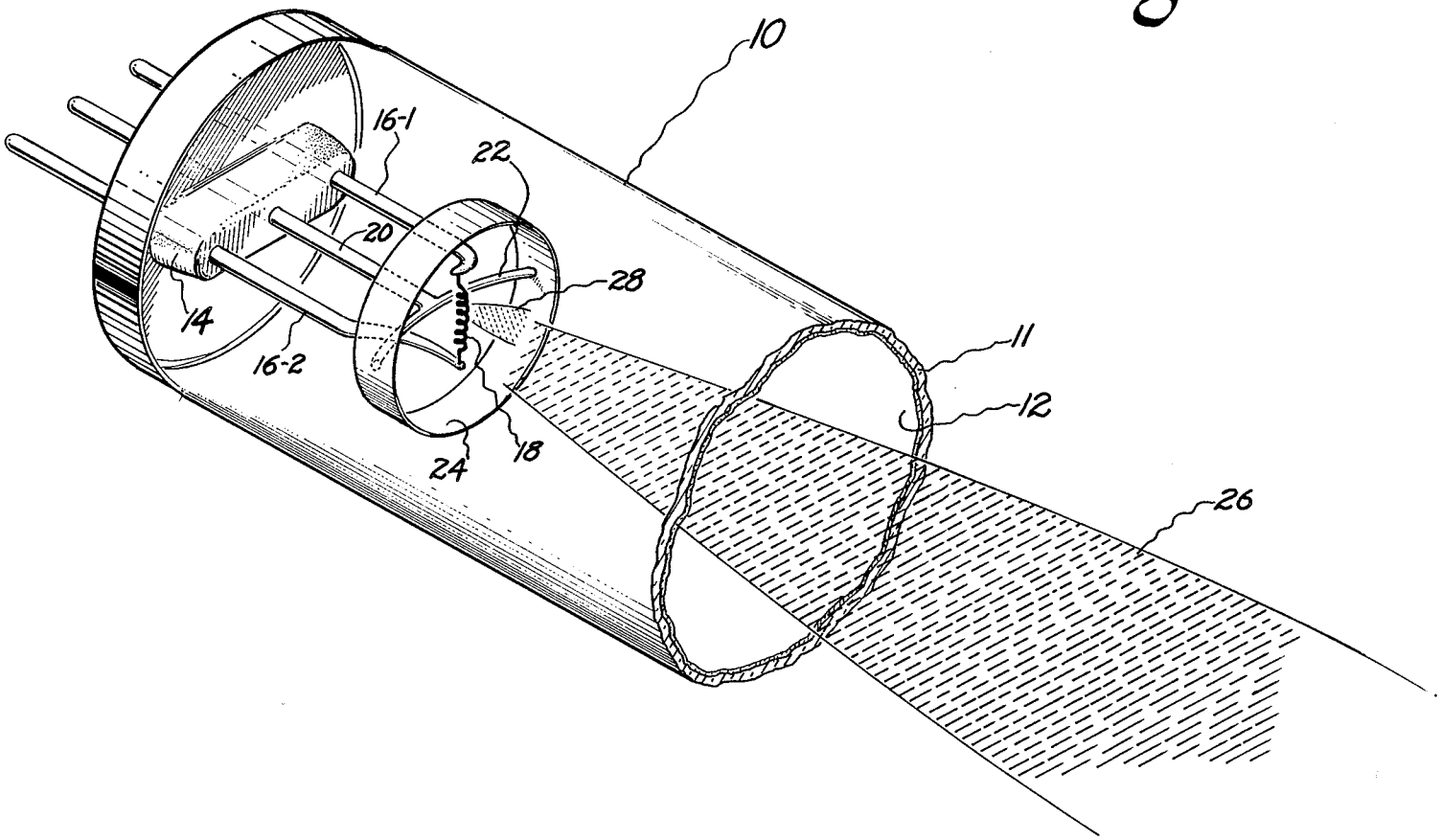
FIG. 1 is a perspective view of a portion of a novel fluorescent lamp, in accordance with the principles of the present invention.

Referring initially to FIG. 1, my novel fluorescent lamp 10 includes a tube 11 of a material, such as glass and the like, forming an envelope capable of sustaining a reduced pressure environment therein, with respect to atmospheric pressure, and capable of allowing visible light to pass therethrough. The visible light is substantially provided by a phosphor layer 12 formed upon the interior glass tube surface, responsive to ultraviolet radiation internally impingent thereon. At either sealed end of tube 11, a press 14 supports and passes therethrough, in pressure-tight manner, first and second conductive members 16-1 and 16-2, having contactable end portions exterior of tube 11 and having opposite end portions interior of tube 11. A conventional fluorescent lamp filament 18 is connected between the interior ends of members 16-1 and 16-2.

In accordance with one principle of the present invention, each lamp end assembly has a third conductive member 20 passing in pressure-tight manner therethrough, to provide contact, preferably via a conductive support member 18 (of illustrated arcuate shape or the like), to a conductive keep-alive electrode means 24 positioned adjacent to the filament supported by that end press. Each keep-alive electrode 24 may be an annular conductive ring or the like shaped member, surrounding at least a portion of the adjacent filament.

A plasma column 26 can be established between the filaments 18 of tube 10, in conventional manner, to supply ultraviolet radiation to phosphor 12 for conversion to visible light. As the plasma column current is varied, to vary the light output of tube 10 over a large light output range, the magnitude of a continuing auxiliary discharge plasma 28, between each filament and its associated keep-alive electrode, is inversely varied to maintain each filament in the spot mode of operation. As increased light from the main column 26 is required, current is shifted from each keep-alive subcircuit (between one filament 18 and the adjacent keep-alive electrode 24) to the the light-producing main column 26 of the lamp. It will be seen that the roles of all electrodes are reversed in each half-cycle of the A.C. interfilament voltage. The lamp can be operated with auxiliary heat being supplied to filament electrodes 18 (such as by the presence of a voltage between the filament support wires 16-1 and 16-2, at the time of lamp starting or otherwise); the auxiliary heat energy can help maintain the filament operation in spot-mode at lower keep-alive current in auxiliary discharge 28. Lamp 10 can also be operated without auxiliary heat.

Figure 2:
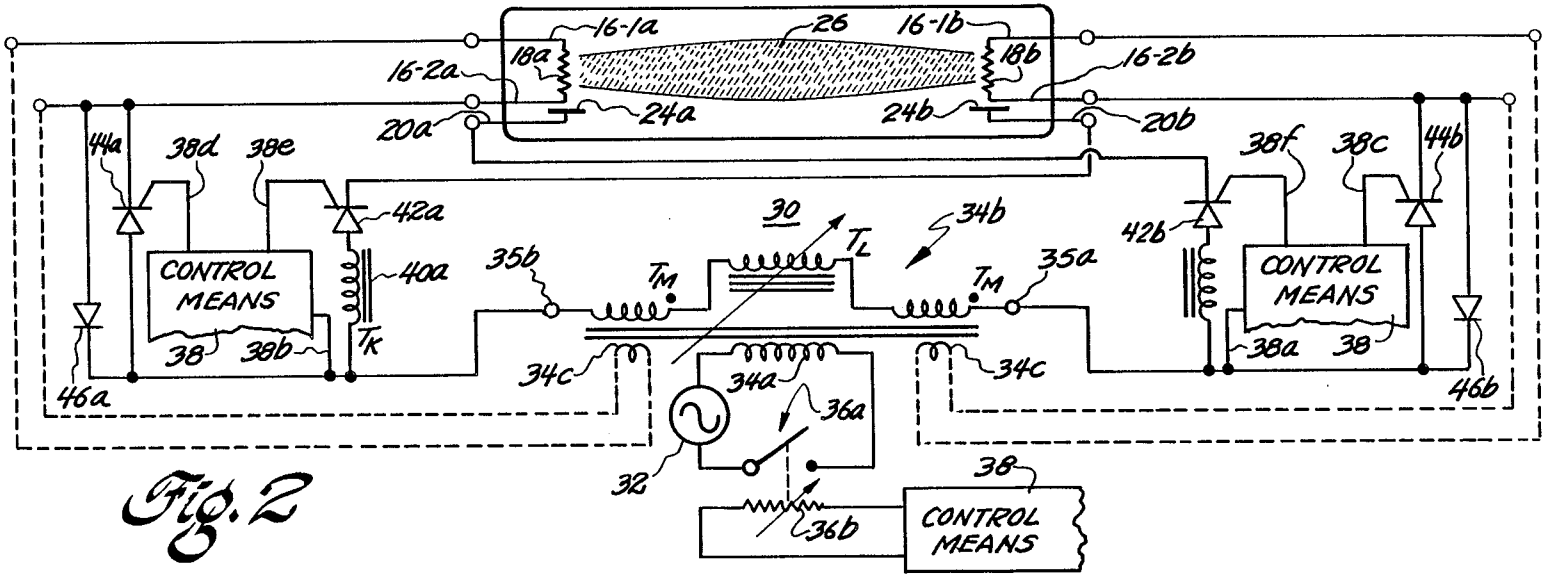
FIG. 2 is a schematic diagram of a presently preferred embodiment of a dimming circuit for operating the novel fluorescent lamp of FIG. 1 over a large light output range.

Referring now to FIG. 2, a presently preferred circuit 30, for dimming operation of my novel fluorescent lamp 10 from an A.C. source 32, includes a leakage-reactance transformer means 34 having a primary winding 34a, with a plurality $T_N$ of turns, and a plurality of secondary windings 34b, including a variable leakage-reactance ballast-action portion having a plurality of winding turns $T_L$, in series connection with at least one other portion having a plurality of winding turns $T_M$, between terminals 35a and 35b. If the lamp is to be operated with auxiliary heat supplied to its filament electrodes, then transformer means 34 can contain auxiliary filament windings 34c. The AC power source is actuatably coupled to transformer means primary winding 34a by action of a switch means 36a, which has coupled thereto a variable lamp light output setting means 36b, such as a variable resistance and the like. Control means 36b is coupled to a lamp output power control means 38 (which acts, as described hereinbelow, to control the "turn-on" phase of switching devices (thyristors) to vary the average current). Each end of the transformer secondary windings 34b is coupled, through an associated one of ballast inductors 40a or 40b, to the anode of a keep-alive electrode switching means 42a or 42b, respectively. Preferably, each of switching means 42 (and switching means 44, to be introduced) is a semiconductor controllable switching device, such as a thyristor and the like. The cathode of the first switching device 42a is connected to one keep-alive electrode 24b; the second keep-alive electrode 24a is connected to the cathode of the second switchable semiconductor device 42b. Each device 42 is thus positioned to control the current in one auxiliary discharge 28. A pair of switching means 44 are provided to control the magnitude of current in the main discharge column 26. The cathode of one of semiconductor switching devices 44a or 44b, respectively, is connected to an associated one of filament contact member 16-2a or 16-2b, respectively, in that end of the lamp containing respective keep-alive electrode 24b or 24a. The anode of each device 44a or 44b is connected to that end of transformer means secondary winding 34b respectively connected to the associated ballast inductor 40a or 40b, respectively, and also to the anode of keep-alive switching device 42a or 42b, respectively. The control electrodes of devices 42a and 44a, which each conduct during at least some portion of one polarity half-cycle of the secondary voltage, are connected to control means outputs 38e and 38d, while the control electrodes of devices 42b and 44b, which each conduct during at least some portion of the other polarity half-cycle of the secondary voltage are connected to control means outputs 38f and 38c. A unidirectionally-conducting device 46a or 46b, respectively, is in reverse-polarity connection across the cathode-anode circuit of the main-current-controlling semiconductor device 44a or 44b, respectively. Devices 46 can each be a semiconductor diode.

Figure 3:
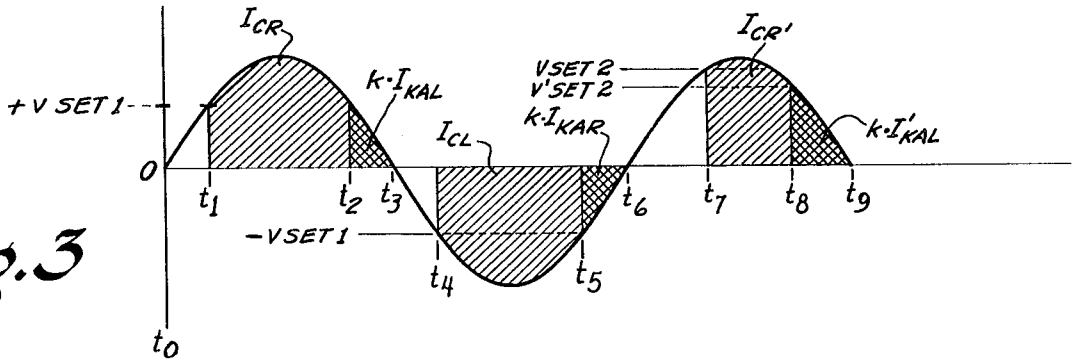
FIG. 3 is a graph indicating several principles of operation of the lamp of FIG. 1 in the circuit of FIG. 2.

Referring now to FIGS. 2 and 3, operation of lamp 10 in circuit 30 commences when switch 36a is closed. One end of the transformer secondary winding becomes positive with respect to the other; assume that the right-hand secondary winding end and terminal 35a are instantaneously positive with respect to the other end and terminal 35b. At some time $t_1$ into this positive half-cycle portion of the source waveform, a first set voltage $V_{set1}$ is reached at control means input 38a (with respect to input 38b) and, as this potential is equal to the potential established by control 36b, control means output 38c is energized to trigger thyristor 44b into conduction, allowing main column current to pass from switching device 44b into lead 16-2b and through filament 18b into filament 18a, through conductive member 16-2a and thence through now-conducting forward-biased diode-46a. The main column current $I_{CR}$ thus flows from right to left in the tube, until the switching device 44b ceases conduction (at the next secondary winding voltage zero crossing, at time $t_3$). In the negative-polarity source waveform half cycle, for the same light output, switching device 44a would be controlled to conduct by energization of control means output 38d at time $t_4$, when the voltage across the transformer means secondary winding reaches $-V_{set1}$. The current $I_{CL}$, flowing from left filament 18a to right filament 18b, continues until the secondary winding waveform reaches its next zero crossing, at time $t_6$. During the same positive-polarity and negative-polarity half cycles, the left and right keep-alive electrodes are each controlled, during at least a portion of each source waveform half-cycle, to be positive with respect to the adjacent filament. Thus, at some time $t_2$, perhaps when the transformer secondary winding voltage is again at the first set voltage value, a third control means output 38f is individually energized to control switching device 42b into conduction, so that some keep-alive current flows between filament 18a and now-positive keep-alive electrode 24a. The commencement of keep-alive current flow, in each half-cycle, can be preset to be inversely proportional to the primary column current (i.e. primary column current is equal to $k/I_{KAL}$), where k is a selected function (possibly constant) and $I_{KAL}$ is the keep-alive current from the left electrode 24a. Similarly, during the negative-polarity half cycle, the keep-alive electrode 24b is at a positive potential, with respect to the now-negative filament 18b, because another control means output 38e individually energizes switching device 42a into conduction at time $t_5$, so that a keep-alive current $I_{KAR}$ flows from the right keep-alive electrode to the right filament.

By adjustment of variable resistance 36b, for example, known phase-control techniques allow variation of the time at which main-current-controlling switching devices 44a and 44b begin to conduct, to vary the light output. As shown at the right side of FIG. 3, the light output is reduced as the main column current is reduced, by shortening the total conduction percentage of each half-cycle; the time $t_7$ in the next positive-polarity half cycle is further from the previous positive-going zero crossing time $t_6$, with respect to the time $t_1$ of the previous positive-polarity half cycle from the positive-going zero crossing time $t_O$ thereof. Therefore, the new turn-on voltage $V_{set2}$ is greater than the previous turn on voltage $V_{set1}$, and the total current $I'_{CR}$ is less than the current $I_{CR}$ flowing in the previous cycle, so that the light output from the lamp has decreased. Conversely, the total conduction time increases for increased light output. In accordance with another principle of the present invention, for reduced main column current and light output, each auxiliary discharge current increases. Thus, the keep-alive current $I'_{KAL}$ "on" time interval, between the left keep-alive electrode 24a turn-on time $t_8$ and the turn-off time $t_9$ thereafter, is greater than the keep-alive current $I_{KAL}$ "on" time interval (from time $t_2$ to $t_3$) in the previous cycle; the same increase occurs in the right electrode 24b "on" time interval. The auxiliary discharge current "on" time interval decreases as main discharge column current, and lamp light output, increases. It should be understood that the new auxiliary turn-on level $V'_{set2}$ need not remain equal to the new main column turn-on voltage $V_{set2}$. It should also be understood that the keep-alive current flow to any one electrode 24 may have to be restarted during each source waveform cycle, which may require a reignition spike, so that the appropriate one of inductors 40 provides ballast action to control the keep-alive current. The keep-alive discharge 28 will itself provide a small amount of light, preventing dimming of the lamp completely to zero output. The keep-alive discharge, being confined to the tube ends, is a relatively poor ultraviolet radiation producer, so there is very little phosphor excitation; the amount of main column light can be diminished to zero, so that the total light (at minimum) is relatively small. It should also be understood that a keep-alive electrode 24 need not be a cylinder or annular ring, and need only be placed in such a position, with respect to the associated filament, as to allow an unobstructed negative glow discharge to develop without formation of a positive discharge column. The configuration of the discharge column immediately surrounding the cathode spot is that necessary for allowing the outer edge glow current to be switched from keep-alive discharge 28 to main column discharge 26. The area of keep-alive anodes 24 need only be that area adequate to collect the electrons of the desired keep-alive current, without causing a voltage rise greater than a predetermined magnitude.

In a typical F40 form of lamp 10, operating at a potential of about 100 volts between filaments 18a and 18b, with a total current flow of 420 mA., the electrodes, acting as cathodes, have voltage drops of about 15 volts. Each keep-alive electrode has a current in the range between about 100 mA. and about 50 mA., for main column currents in the 4–400 mA. range, yielding about a 100:1 desired dimming range, as light output is approximately proportional to lamp main discharge current. The keep-alive power might therefore be about 1.5 watts per electrode (15 volts of electrode drop at 100 mA. of keep-alive electrode current), although the current will flow only on alternate half cycles and thus reduce the average power.

While one presently preferred embodiment of my novel lamp and one presently preferred embodiment of a circuit for controlling this lamp in accordance with my novel method for fluorescent lamp dimming over a large light output range, have been described in detail herein, many modifications and variations will now become apparent to those skilled in the art. It is my intent, therefore, to be limited only the scope of the appending claims and not be way of the specific details and instrumentalities provided by way of explanation of the embodiments herein.

What I claim is:

1. In a fluorescent lamp of the type having a plurality of filament means and a current discharge column therebetween for stimulating the production of visible radiation, the improvement comprising: keep-alive electrode means adjacent to at least one of said filament means for forming between said filament means and the keep-alive electrode means a keep-alive discharge passing sufficient current, substantially separate from said discharge column current, to maintain the adjacent filament means in a spot mode of operation as the average current of said discharge column is varied to cause at least a 10:1 variation in the visible light output of said lamp.

2. The improved lamp of claim 1, wherein a keep-alive electrode means is positioned adjacent to each filament means.

3. The improved lamp of claim 2, wherein said lamp has two filament means and a different one of a pair of keep-alive electrode means is positioned adjacent to each filament means.

4. The improved lamp of claim 3, wherein each keep-alive electrode means is an annular conductive member positioned adjacently about the associated filament means.

5. The improved lamp of claim 4, further comprising means for individually positioning and supporting each keep-alive electrode means.

6. The improved lamp of claim 5, wherein said positioning and supporting means is also a conductive means for providing an external connection to the associated keep-alive electrode means.

7. A method for operating, from an A.C. source, a fluorescent lamp of the type having a plurality of filaments and a current discharge column therebetween for stimulating production of at least a 10:1 variation of visible lamp light output, comprising the steps of:

(a) providing from the source of AC voltage between the filaments at an amplitude sufficient to cause the current discharge to occur;

(b) adjusting the time interval, during each source half-cycle, during which the discharge current flows, to control the average column current over a range sufficient to cause at least a 10:1 variation in the visble lamp light output;

(c) providing the lamp with the keep-alive electrode adjacent to at least one of the filaments;

(d) maintaining each keep-alive electrode at a sufficiently positive potential, whenever another filament is at at positive potential, both with respect to that adjacent filament, to cause an auxiliary discharge to occur between that pair of keep-alive electrode and adjacent filament; and (e) independently adjusting the time interval, during each source cycle, during which the auxiliary discharge occurs, to cause the auxiliary discharge to maintain the adjacent filament in a spot mode of operation for substantially all of the source cycle.

8. The method of claim 7, further comprising the steps of: providing a keep-alive electrode adjacent to each filament; and maintaining and adjusting each auxiliary discharge, between each pair of adjacent filament and keep-alive electrode, to operate that filament in a spot mode of operation for substantially all of the source cycle.

9. The method of claim 8, wherein each auxiliary discharge is extinguished during at least a portion of the source cycle, and further comprising the step of reigniting the auxiliary discharge into conduction at least once in each source cycle.

10. The method of claim 8, wherein step (e) includes the step of respectively increasing and decreasing the duration of the time interval of each auxiliary discharge conduction in each source cycle, responsive to the respective decrease and increase of discharge column current.

11. The method of claim 9, wherein the average current in each auxiliary discharge is substantially inversely proportional to the discharge column current.

12. Apparatus for providing at least a 10:1 variable range of visible light magnitude, comprising:

a fluorescent lamp having a main current discharge between first and sescond filament means, and having a keep-alive electrode adjacent to each filament means;

means for providing an A.C. operating potential between first and second terminals;

first and second individually-controllable main switching means respectively for individually connecting the respective first and second terminals to a respective one of said first and second filament means, responsive to respective first and second signals;

first and second individually-controllable auxiliary switching means respectively for individually coupling the respective first and second terminals to that keep-alive electrode adjacent to the respective second and first filament means, responsive to respective third and fourth signals;

means in electrical parallel connection with each of said main switching means for allowing reverse current flow past that parallel-connected switching means;

means for setting a desired level of visible light; and control means for providing said first and second signals with characteristics to control the average current in the main discharge to a magnitude to provide substantially the desired visible light level, over said at least 10:1 range, and for also providing said third and fourth signals with characteristics to cause an auxiliary discharge to be present, between each filament means and the associated keep-alive electrode, with characteristics sufficient to maintain that associated filament means in the spot mode of operation over the entire range of lamp visible light output.

13. The apparatus of claim 12, wherein the operating-potential-providing means comprises leakage-reactance transformer means having a primary winding energizable from an AC source, and at least one secondary winding series connected between said first and second terminals.

14. The apparatus of claim 13, further comprising: a first ballast inductor connected between the first terminal and the second keep-alive electrode; and a second ballast inductor connected between the second terminal and the first keep-alive electrode.

15. The apparatus of claim 14, wherein each of said switching means is a semiconductor switching device having a controlled-current circuit in series connection between the associated terminal and the associated one of first and second filaments and first and second keep-alive electrodes, and having a control electrode receiving the associated one of the first through fourth signals for controlling the flow of current in the controlled-current circuit of that switching device.

16. The apparatus of claim 15, wherein each switching device is a thyristor.

17. The apparatus of claim 15, wherein each of the reverse-current-flow-allowing means is a semiconductor diode.

18. The apparatus of claim 14, wherein said transformer means further comprises means for energizing the lamp filament means to provide auxiliary heat at least during initial ignition and formation of the main current discharge.

19. The apparatus of claim 14, wherein the control means controls the time duration of intervals of current conduction in all the first through fourth switching means over a range sufficient to vary the lamp visible light output over at least a 100:1 range.

20. The apparatus of claim 19, wherein the transformer means provides an average potential on the order of 100 volts between the filament means, and an average potential on the order of 15 volts is applied between each pair of filament means and associated keep-alive electrode for at least a portion of the source cycle.

* * * * *